United States Patent [19]

Brunner et al.

[11] Patent Number: 4,469,080

[45] Date of Patent: Sep. 4, 1984

[54] IGNITION CONTROL BYPASS CABLE

[76] Inventors: William R. Brunner; Donald W. Brunner, both of 3 Eton Dr., North Caldwell, N.J. 07006

[21] Appl. No.: 427,422

[22] Filed: Sep. 29, 1982

[51] Int. Cl.[3] ..... F02P 15/00

[52] U.S. Cl. ..... 123/595; 123/640

[58] Field of Search ..... 123/640, 594, 595, 617

[56] References Cited

U.S. PATENT DOCUMENTS

| | | | |
|---|---|---|---|
| 4,000,729 | 1/1977 | Clark, Jr. | 123/640 |
| 4,069,801 | 1/1978 | Stevens | 123/640 |
| 4,207,851 | 6/1980 | Crisefi | 123/640 |
| 4,331,122 | 5/1982 | Söhner et al. | 123/595 |

FOREIGN PATENT DOCUMENTS

| | | | |
|---|---|---|---|
| 1521742 | 8/1978 | United Kingdom | 123/595 |

*Primary Examiner*—Andrew M. Dolinar
*Attorney, Agent, or Firm*—Edward R. Weingram

[57] ABSTRACT

An auxiliary cable having a plurality of wires and connecting terminals at each end provides electrical connections between an electronic ignition control unit and engine starting elements to permit starting a vehicle internal combustion engine despite a malfunctioning spark timing control unit. The cable includes five insulated wire conductor leads with a receptacle at one end which mates with an external plug on the electronic ignition control unit and a plug on the other end which engages a receptacle connected to the engine starting elements. Two wires connect the magnetic pick-up coil of the distributor unit to the input stage of the electronic ignition control; a third wire connects the output of the ignition control to one side of the ignition coil; a fourth wire connects the positive direct voltage supply terminal of the ignition control to the positive terminal of the ignition coil and through the ignition switch to the battery; and the fifth wire connects the ground or chassis of the ignition control to the ground terminal of the starter elements. The cable bypasses the normal connections between the ignition control unit, spark timing control unit and engine starting elements. The spark control unit is disconnected from the engine elements with the cable making direct connections between the external plug on the ignition control unit and the engine starting elements.

5 Claims, 4 Drawing Figures

IGNITION CONTROL BYPASS CABLE

BACKGROUND OF THE INVENTION

1. Field of the Invention

The present invention relates to engine ignition devices for starting engines with malfunctioning electronic controls and particularly to an auxiliary cable which connects the electronic ignition control to the engine starting elements to bypass a defective spark timing control circuit.

2. Description of the Prior Art

With the advent of electronic devices for controlling engine ignition and spark timing, failure of the electronic components has frequently caused the engine to become inoperative and incapable of being restarted. The disabled motor vehicle must then be towed in to a service station. Examples of an electronic ignition control device and a spark timing control circuit are found in U.S. Pat. Nos. 3,749,974 and 3,885,534. Attempts to provide auxiliary or emergency ignition devices have included complex circuits to generate pulses supplied to an ignition coil such as shown in U.S. Pat. No. 4,000,729, or high voltage generators such as described in U.S. Pat. No. 4,207,851. These circuits, however, have not provided a device for locating the problem of a malfunctioning spark control unit which disables the engine or for starting the engine despite the defective component.

SUMMARY OF THE INVENTION

It is, therefore, the primary object of the present invention to provide a simple, easily installed passive device which permits starting an internal combustion engine despite a malfunctioning spark timing control unit. Another object of the invention is to provide an auxiliary cable connecting an electronic ignition control unit to the engine starting elements to locate and bypass a defective spark control unit to permit emergency starting of the engine so that a disabled motor vehicle can be driven to a service station.

This is accomplished by a cable having a plurality of wires and connecting terminals at each end which provides direct connections between the electronic ignition control unit and the engine starting elements. The spark timing control unit normally connected between the ignition control unit and the engine starting elements is disconnected so that the cable bypasses the defective spark control unit. The cable includes a receptacle at one end that mates with an external plug on the electronic ignition control unit and a plug at the other end that engages a receptacle connected to the distributor, battery, ignition switch and ignition coil of the engine. Five insulated wire conductor leads are connected between the terminals at each end and include two wires connected between the input posts of the electronic ignition control unit and the magnetic pick-up coil of the distributor. A third wire connects the output of the ignition control unit to the primary winding of the ignition coil; a fourth wire connects the positive direct voltage supply terminal of the ignition control unit to the positive terminal of the ignition coil and to the battery through the ignition switch; and the fifth wire connects the ground or chassis of the ignition control unit to a ground reference terminal associated with the starting elements. Other objects and advantages will become apparent from the following description in conjunction with the accompanying drawings.

DESCRIPTION OF THE PREFERRED EMBODIMENT

Figure 1:
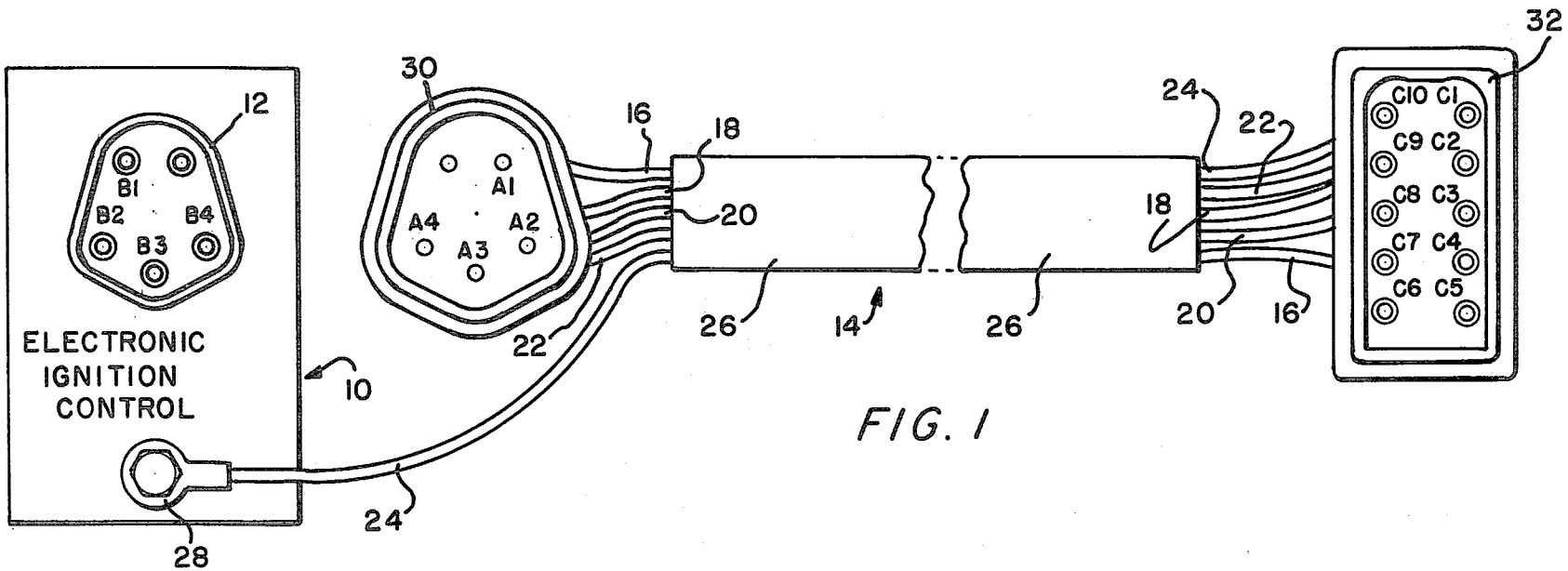
FIG. 1 is a view of the auxiliary cable showing the wires connected to an ignition control unit receptacle and the control unit at one end and a plug at the other end for connection to the engine starting elements.
Figure 3:
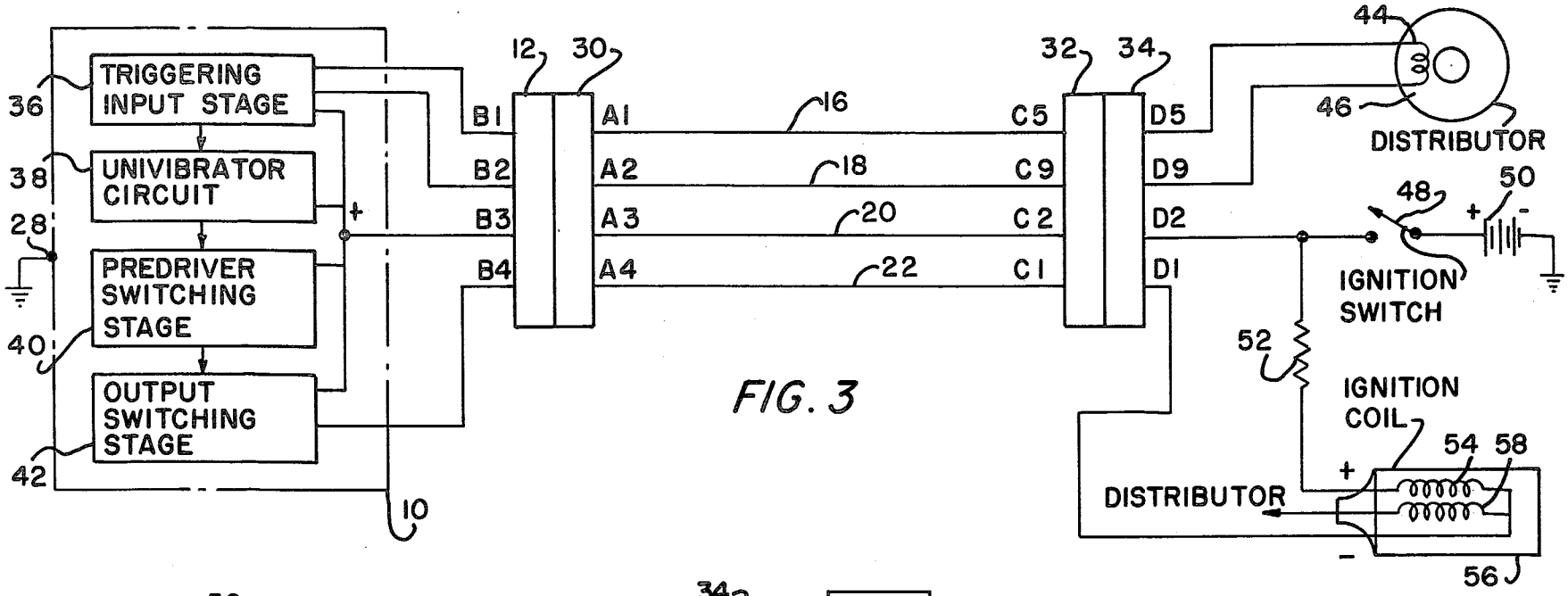
FIG. 3 is a schematic block diagram showing the auxiliary cable connected between the various stages of the electronic ignition control unit at one end and the engine starting elements at the other end.

As shown in FIGS. 1 and 3, an electronic ignition control unit 10 is normally connected directly and internally to a spark timing control unit which is connected to the engine starting elements of an internal combustion engine such as described in U.S. Pat. Nos. 3,885,534 and 3,749,974. Failure of the spark timing control unit such as shown in FIG. 1, of the above noted U.S. Pat. No. 3,885,534, causes the engine to be disabled and prevents it from being restarted. In order to provide an emergency starting capability, the normal electronic ignition control unit is replaced with one having a plug 12 with external pin connections. The spark control unit is disconnected from a receptacle that connects to the engine starting elements and the auxiliary cable 14 of the present invention is connected between the ignition control unit and the engine starting elements to bypass the spark control unit and permit starting the engine.

Figure 2:
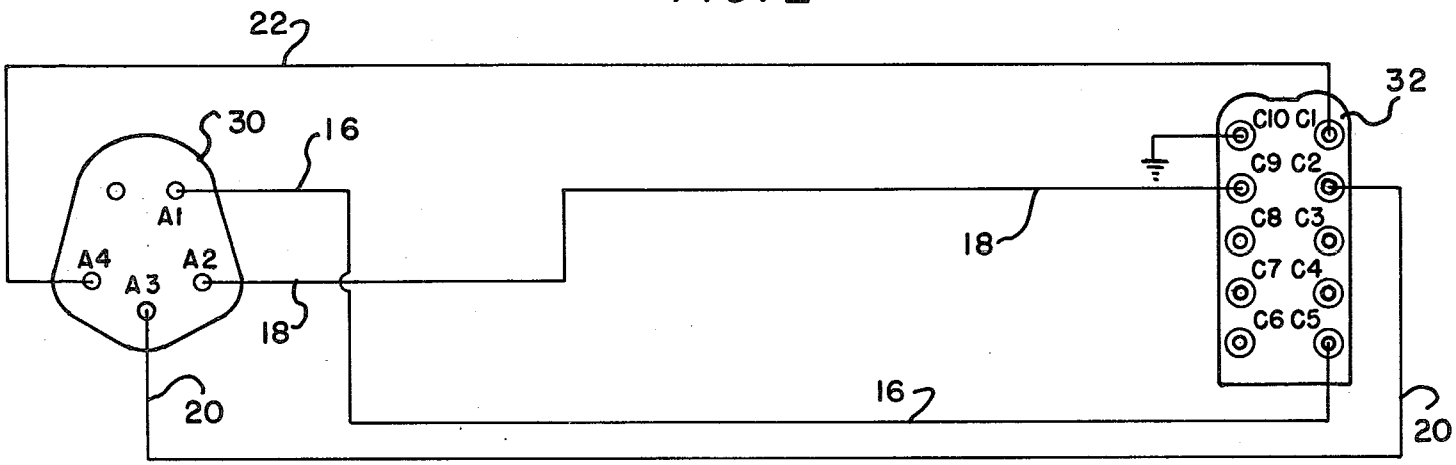
FIG. 2 is a schematic diagram of the auxiliary cable with the wires connected to terminals at each end.

The auxiliary cable includes five insulated wire conductors or leads 16, 18, 20, 22, and 24 which are enclosed in an outer layer of insulation 26. Lead 14 is connected at one end to a ground terminal 28 on the electronic ignition control unit 10. Leads 16, 18, 20, and 22 are connected respectively at the same end to terminals A1, A2, A3, and A4 of a receptacle 30 which is adapted to engage plug 12 and pins B1, B2, B3, and B4 of the ignition control unit. The unmarked fifth pin is not used. At the other end of the cable, lead 16 is connected to pin C5, lead 18 to pin C9, lead 20 to pin C2, lead 22 to pin C1 and lead 24 to pin C10 of a plug 32 which is adapted to engage a receptacle 34, shown in FIGS. 3 and 4, that connects to the engine starting elements. Receptacle 34 is the one which normally engages a plug from the spark timing control unit that is now disconnected, with plug 32 of the present cable being inserted in its place. FIG. 2 shows the cable connections schematically with the ground lead 24 being omitted and pin C10 of plug 32 shown connected to ground.

As shown in FIG. 3, the auxiliary cable leads 16 and 18 connect through receptacle 30 and plug 12 to a triggering input stage 36 of the electronic ignition control unit 10. Stage 36 is coupled to a univibrator circuit 38 which in turn is coupled to a predriver switching stage 40 and then to an output switching stage 42. The output from stage 42 is then connected through plug 12 and receptacle 30 to lead 22 of the cable. Lead 20 of the cable is shown connected through the receptacle and plug to the positive voltage terminal of the ignition control unit 10, while terminal 28 is shown connected to ground. The other end of the cable shows leads 16 and 18 connected through plug 32 to pins D5 and D9 of receptacle 34 which connects to a magnetic pick-up coil 44 of a distributor 46. Lead 20 is connected through plug 32 to pin D2 of receptacle 34 which in turn connects to an ignition switch 48 and the positive terminal of battery 50. Lead 20 also connects to a ballast resistor 52 and through the resistor to one side of the primary winding 54 of ignition coil 56. Lead 22 is connected from the output of ignition control unit 10 through plug 32 to pin D1 of receptacle 34 which connects to the other side of primary winding 54 of ignition coil 56. The secondary winding 58 is then coupled to the distributor for starting the engine.

Figure 4:
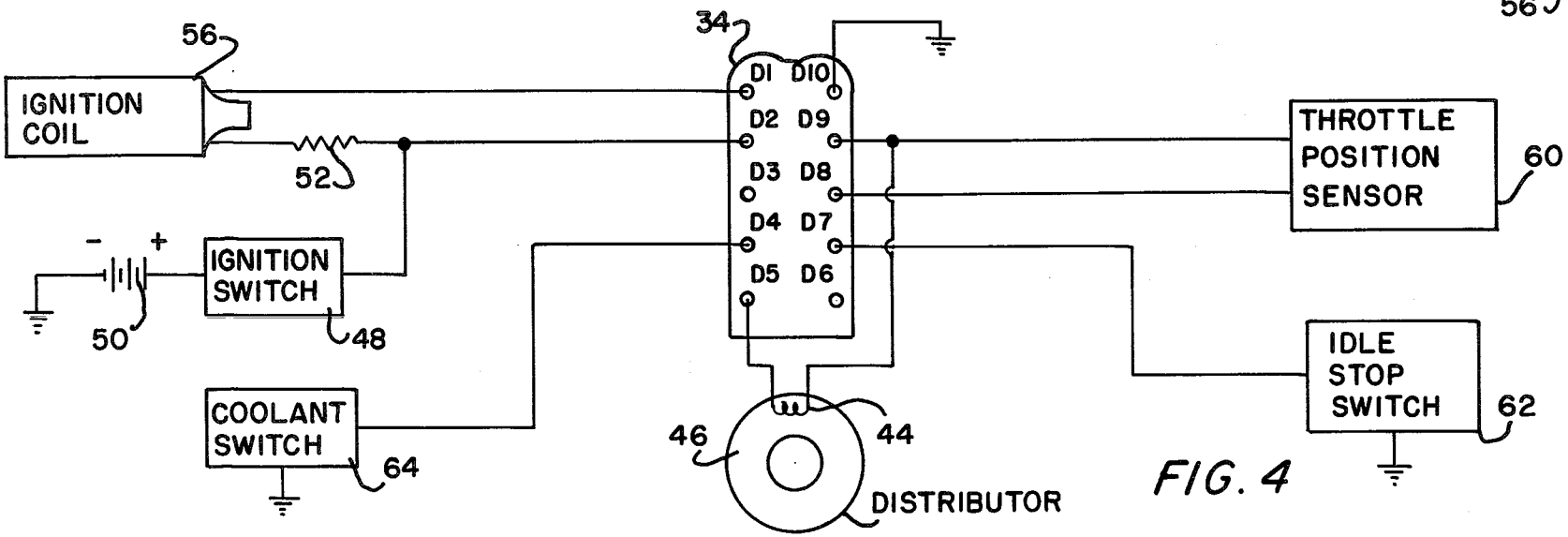
FIG. 4 is a schematic block diagram of the receptacle and connections to the engine starting and associated elements showing the terminals that engage the auxiliary cable plug.

FIG. 4 shows receptacle 34 in further detail with connections to additional elements normally associated with the engine spark timing control unit such as throttle position sensor 60, idle stop switch 62 and coolant switch 64. These additional elements, however, are now not connected by the present cable since they are not concerned with the emergency starting of the engine. The auxiliary cable thus bypasses a defective spark control unit and provides connections between the electronic ignition control unit and only the essential engine starting elements including the ignition coil, ignition switch and battery, and distributor.

The present invention thus provides a novel device which permits emergency starting of an engine disabled by malfunctioning electronic controls. While only a single embodiment has been illustrated and described, it is apparent that other variations may be made in the particular design and configuration without departing from the scope of the invention as set forth in the appended claims.

What is claimed is:

1. An auxiliary ignition control cable for use with a vehicle having an electronic ignition control device including a first external connector means and a spark timing control device adapted to be connected between said first external connector means and a second connector means having connections to engine starting elements including an ignition coil having primary and secondary windings, an ignition switch, a source of direct voltage having a positive terminal and a ground reference, and a distributor having a magnetic pick-up coil, comprising:

a plurality of insulated wire conductors having respective terminals at one end adapted to be connected to mating terminals of said first external connector means and terminals at the other end adapted to be connected to mating terminals of said second connector means, including a pair of wire leads at said one end adapted for connection to a pair of input terminals of said electronic ignition control device and at said other end being adapted for connection to the magnetic pick-up coil of said distributor, said ignition control device including an output terminal, a third wire lead at said one end adapted for connection to a positive voltage supply line of said ignition control device and at the other end being adapted for connection to said ignition switch and positive terminal of said source of direct voltage and one side of said ignition coil, a fourth wire lead at said one end adapted for connection to said output terminal of said ignition control device and at the other end being adapted for connection to the other side of said ignition coil, and a fifth wire lead at said one end adapted for connection to a ground reference of said ignition control device and at the other end being adapted for connection to the ground reference of said source of direct voltage.

2. The device of claim 1, wherein said first external connector means is a first plug and said second connector means is a first receptacle, said plurality of terminals at said one end including a second receptacle adapted to engage said first plug, and said terminals at said other end including a second plug adapted to engage said first receptacle.

3. The device of claim 2, wherein said first, second, third, and fourth wire leads are connected to respective terminals of said second receptacle as said one end and said second plug at said other end.

4. The device of claim 3, wherein said fifth wire lead is connected directly to a ground reference of said ignition control device at said one end and to a terminal of said second plug at said other end adapted for connection to said ground reference of said source of direct voltage.

5. The device of claim 4, wherein said third wire lead at said other end is adapted for parallel connection to one side of said ignition switch and one side of a ballast resistor, the other side of said ignition switch being connected to said positive terminal of said source of direct voltage and the other side of said resistor being connected to said one side of said ignition coil.

* * * * *